US011944895B2

(12) United States Patent
Marusiak et al.

(10) Patent No.: US 11,944,895 B2
(45) **Date of Patent: *Apr. 2, 2024**

(54) DUAL AXLE SKATEBOARD AND TRUCK WITH OUTBOARD SECONDARY WHEELS AND METHODS

(71) Applicant: KARSTEN MANUFACTURING CORPORATION, Phoenix, AZ (US)

(72) Inventors: John R. Marusiak, Phoenix, AZ (US); John A. Solheim, Phoenix, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/461,577

(22) Filed: Aug. 30, 2021

(65) Prior Publication Data

US 2021/0387077 A1 Dec. 16, 2021

Related U.S. Application Data

(60) Continuation of application No. 16/747,397, filed on Jan. 20, 2020, now Pat. No. 11,130,046, which is a (Continued)

(51) Int. Cl.
*A63C 17/00* (2006.01)
*A63C 17/01* (2006.01)

(52) U.S. Cl.
CPC ..... *A63C 17/012* (2013.01); *A63C 17/004* (2013.01); *A63C 17/0093* (2013.01); *A63C 17/014* (2013.01)

(58) Field of Classification Search
CPC ..... A63C 17/01; A63C 17/012; A63C 17/004; A63C 17/0093; A63C 17/014

(Continued)

(56) References Cited

U.S. PATENT DOCUMENTS 2,253,012 A 8/1941 Benner
4,062,557 A * 12/1977 Roden ..... A63C 17/01 280/11.27

(Continued)

FOREIGN PATENT DOCUMENTS

JP H03198878 8/1991
RU 2440836 1/2012

(Continued)

OTHER PUBLICATIONS

PCT International Search Report and Written Opinion dated Aug. 12, 2015 from corresponding PCT Application No. PCT/US 2015/049596 filed Sep. 11, 2015.

*Primary Examiner* — Hau V Phan

(57) ABSTRACT

Improved skateboards and methods of obtaining or providing skateboards with improved trucks. Trucks have two axles or axes, two primary wheels, and two secondary wheels, and skateboards have eight wheels, four in front and four at the rear portion of the skateboard. The four primary wheels support most or all of the weight of the skateboard when the skateboard is on a flat surface, and the two secondary wheels support the weight of one portion of the skateboard (e.g., front or rear) when the primary wheels cross a crack (e.g., a sidewalk contraction joint). In various embodiments, the secondary wheels are located outboard of the primary wheels. Further, in a number of embodiments, the axis of rotation or axle of the primary wheels remains parallel to that of the secondary wheels, whether the skateboard is going straight or turning.

20 Claims, 4 Drawing Sheets

Related U.S. Application Data continuation of application No. 15/887,091, filed on Feb. 2, 2018, now Pat. No. 10,561,927, which is a continuation of application No. 15/343,325, filed on Nov. 4, 2016, now Pat. No. 9,925,452, which is a division of application No. 14/806,419, filed on Jul. 22, 2015, now Pat. No. 9,492,731, which is a continuation-in-part of application No. 14/487,955, filed on Sep. 16, 2014, now Pat. No. 9,138,633.

(58) Field of Classification Search
USPC ..... 280/87.042
See application file for complete search history.

(56) References Cited

U.S. PATENT DOCUMENTS

| | | | | |
|---|---|---|---|---|
| 4,095,817 | A | 6/1978 | Cohen | |
| 4,133,548 | A | 1/1979 | Smith | |
| 4,886,298 | A | 12/1989 | Shols | |
| 4,911,456 | A * | 3/1990 | Sarazen | A63C 17/1409 280/11.28 |
| 5,096,225 | A | 3/1992 | Osawa | |
| 5,165,708 | A | 11/1992 | I-Chuan | |
| 5,195,781 | A | 3/1993 | Osawa | |
| 5,458,351 | A | 10/1995 | Yu | |
| 5,492,352 | A | 2/1996 | St. Clair | |
| 5,673,941 | A | 10/1997 | Osawa | |
| 5,803,473 | A | 9/1998 | Bouden | |
| 5,833,252 | A | 11/1998 | Strand | |
| 5,908,196 | A | 6/1999 | Weiss | |
| 5,947,495 | A * | 9/1999 | Null | B60T 1/08 280/87.01 |
| 6,019,382 | A | 2/2000 | Bouden | |
| 6,158,753 | A | 12/2000 | Sturbaum | |
| 6,698,776 | B2 | 3/2004 | Todd | |
| 7,083,178 | B2 | 8/2006 | Potter | |
| 7,441,787 | B1 | 10/2008 | Jordan | |
| 7,618,046 | B2 | 11/2009 | Green | |
| 8,398,099 | B2 | 3/2013 | Edginton | |
| 8,608,185 | B2 * | 12/2013 | Bermal | A63C 17/012 280/87.042 |
| 8,807,577 | B2 | 8/2014 | Lai | |
| 8,910,958 | B2 | 12/2014 | Smith | |
| 9,138,633 | B1 * | 9/2015 | Marusiak | A63C 17/014 |
| 9,492,731 | B2 * | 11/2016 | Marusiak | A63C 17/004 |
| 9,925,452 | B2 * | 3/2018 | Marusiak | A63C 17/014 |
| 10,561,927 | B2 * | 2/2020 | Marusiak | A63C 17/004 |
| 11,130,046 | B2 * | 9/2021 | Marusiak | A63C 17/004 |
| 2003/0141688 | A1 * | 7/2003 | Lynn | A63C 17/0093 280/87.042 |
| 2008/0179844 | A1 | 7/2008 | DiDomizio | |
| 2010/0090423 | A1 | 4/2010 | Farrelly | |
| 2010/0225080 | A1 * | 9/2010 | Smith | A63C 17/0033 280/87.042 |
| 2013/0020773 | A1 | 1/2013 | Green | |

FOREIGN PATENT DOCUMENTS

| | | |
|---|---|---|
| WO | 03033089 | 4/2003 |
| WO | 2008142473 | 11/2008 |

* cited by examiner

DUAL AXLE SKATEBOARD AND TRUCK WITH OUTBOARD SECONDARY WHEELS AND METHODS

RELATED PATENT APPLICATIONS

This is a continuation of U.S. patent application Ser. No. 16/747,397, filed on Jan. 20, 2020, which is a continuation of U.S. patent application Ser. No. 15/887,091, filed on Feb. 2, 2018, now U.S. Pat. No. 10,561,927, which is a continuation of U.S. patent application Ser. No. 15/343,325, filed Nov. 4, 2016, now U.S. Pat. No. 9,925,452, which is a divisional of U.S. patent application Ser. No. 14/806,419, filed Jul. 22, 2015, now U.S. Pat. No. 9,492,731, which is a continuation-in-part of U.S. patent application Ser. No. 14/487,955, filed Sep. 16, 2014, now U.S. Pat. No. 9,138,633, the entire contents of which are fully incorporated herein.

FIELD OF THE INVENTION

This invention relates to skateboards, trucks for skateboards, and methods of obtaining and providing skateboards, and other apparatuses, that glide better over cracks, for example, in a sidewalk.

BACKGROUND OF THE INVENTION

Skateboards have been ridden for over half of a century for recreation and as a convenient and entertaining form of transportation. Skateboards have an advantage over most other wheeled forms of transportation in that they can be easily picked up and carried at the destination, for example, into a building. In addition, skilled riders have learned how to perform many different tricks on skateboards and competitions have been held between skateboarders to demonstrate their skills. Skateboards have also been used for cross training and skills development for other balance-oriented sports such as surfing and snow boarding. Skateboards have been ridden on various surfaces including concrete sidewalks that contain various cracks including contraction joints or control joints and expansion joints. When a skateboard is ridden over such a crack, the wheels of the skateboard have descended into the crack and then popped back up when the wheels hit the other side of the crack. This has resulted in detrimental effects including noise, shock to the rider, and impacts on the handling of the skateboard. As a result, skateboard parks have been built that avoid or minimize cracks in the riding surface, among other things. In addition, skateboard wheels have been made larger, have been made from a softer material, or both, to reduce the amount of shock and noise generated when the wheels hit a crack or other irregularity in the riding surface. Room for improvement, however, or potential for benefit or improvement exists to make skateboards ride better over cracks in the sidewalk or riding surface. Needs or potential for benefit or improvement exist for skateboards that glide over cracks, that are inexpensive to manufacture, that utilize existing components to a greater extent, that roll with little friction, that are stable, that handle well, that are suitable for performing various tricks, that are less complex than alternatives, that can be readily manufactured, that are easy to use, that are reliable, that have a long life, that are compact, that can withstand extreme environmental conditions, or a combination thereof, as examples, in whole or in part. Other needs or potential for benefit or improvement may also be described herein or known in the skateboard field. Room for improvement exists over the prior art in these and other areas that may be apparent to a person of ordinary skill in the art having studied this document. Even an incremental improvement over the prior art can make a significant difference in the success of a product in this competitive industry.

Figure 1:
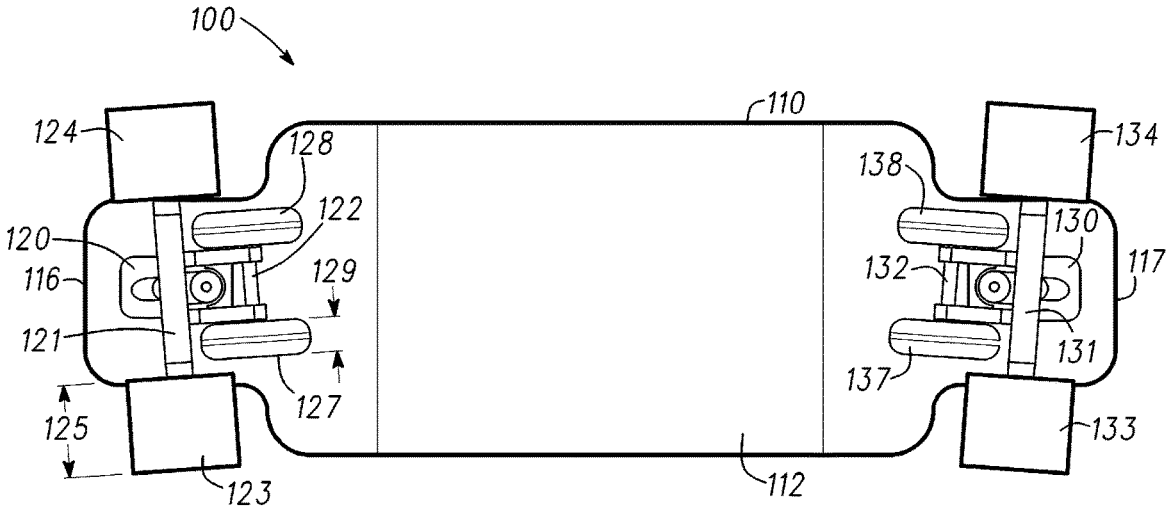
FIG. 1 is a bottom view of a skateboard having two dual-axle trucks, the skateboard having four primary wheels and four secondary wheels, the skateboard shown with the trucks, axles, and wheels in the position when the skateboard turns to the right, and shown with the front of the skateboard on the left hand side of this view, this embodiment having the primary wheels outboard of the secondary wheels.

These drawings illustrate, among other things, examples of certain aspects of particular embodiments of the invention. Other embodiments may differ. For example, in some embodiments, components or acts may be omitted, or acts may be performed in a different order. Various embodiments may include aspects shown in the drawings, described in the specification, shown or described in other documents that are incorporated by reference, known in the art, or a combination thereof, as examples.

DETAILED DESCRIPTION OF EXAMPLES OF EMBODIMENTS

A number of embodiments of the subject matter described herein include improved trucks for skateboards, skateboards having improved trucks, and methods, for example, of obtaining or providing skateboards with improved trucks or improved trucks for skateboards. In a number of embodiments, skateboards have eight wheels, four at the front of the skateboard and four at the rear of the skateboard. These eight wheels consist, in a number of embodiments, of four primary wheels, that support most or all of the weight of the skateboard most of the time, and four secondary wheels that support the weight of one end of the skateboard (e.g., the front or the rear) when the primary wheels cross a crack (e.g., in the sidewalk). In various embodiments, two primary wheels are located at the front of the skateboard and two primary wheels are located at the rear of the skateboard. Similarly, in a number of embodiments, two secondary wheels are located at the front of the skateboard and two secondary wheels are located at the rear of the skateboard. In some embodiments, the primary wheels are located outboard of the secondary wheels. In other embodiments, however, the secondary wheels are located outboard of the primary wheels. Further, in a number of embodiments, in each truck, the axis of rotation or axle of the primary wheels remains parallel to the axis of rotation or axle of the secondary wheels, whether the skateboard is going straight or turning.

FIGS. 1 to 6 illustrates an example of a skateboard, skateboard 100, to be ridden by a rider (not shown). The rider has a weight [i.e., the rider's body weight, clothing, personal protective equipment (e.g., without limitation, helmet, wrist guards, elbow pads, and knee pads, as appropriate) and anything else the rider is wearing or carrying such as a back pack] which is supported by the skateboard when the skateboard is ridden. In the example shown, skateboard 100 includes body 110 having top surface 111 (e.g., shown in FIGS. 2 and 4) for supporting the rider (i.e., of the skateboard), bottom surface 112 (e.g., shown in FIG. 1) opposite top surface 111, front portion 116, and rear portion 117 opposite front portion 116. In this embodiment, skateboard 100 also includes front truck 120 (e.g., shown in FIGS. 1-3, 5, and 6) attached to bottom surface 112 of body 110 of skateboard 100 at front portion 116 of body 110. In this particular embodiment, front truck 120 includes primary front axle 121, and two primary front wheels 123 and 124 rotatably mounted (i.e., mounted so they can rotate) on primary front axle 121. In a number of embodiments, the wheels (e.g., 123 and 124) rotate about the axle (e.g., axle 121), on ball bearings (not shown).

Further, in various embodiments, such a truck (e.g., 120) includes at least one secondary front axle. In the embodiment illustrated, for example, truck 120 includes one secondary front axle 122. Further still, in a number of embodiments, the least one secondary front axle is parallel to the primary front axle, and in the embodiment illustrated, for instance, secondary front axle 122 is parallel to primary front axle 121. As used herein, two axles are considered to be parallel if they are parallel to within 10 degrees. In a number of embodiments, however, the primary and secondary axles are parallel to within a smaller angle. In various embodiments, for example, the primary and secondary axles are parallel to within 5, 4, 3, 2, or 1 degrees, as examples, or within an even smaller angle. In a number of embodiments the primary and secondary axles remain parallel when the skateboard (e.g., 100) turns, for instance, as a result of the rider tilting the skateboard to one side or leaning.

Even further, in the embodiment illustrated, truck 120 includes two secondary front wheels 127 and 128 that are rotatably mounted on the at least one secondary front axle 122. In this embodiment, there is just one secondary axle (e.g., secondary front axle 122), but in other embodiments, there are two secondary axles, for instance, one for each wheel (e.g., front wheels 127 and 128). Moreover, in some embodiments having two secondary axles, the two secondary axles are in line with each other and have a common centerline (e.g., as used herein, to within 10 degrees and to within the diameter of the secondary axle, unless stated otherwise). Other embodiments, however, may differ.

In the embodiment shown, skateboard 100 also includes rear truck 130 (e.g., shown in FIGS. 1 and 2) attached to bottom surface 112 of body 110 of skateboard 100 at rear portion 117 of body 110. In some embodiments, rear truck 130 is the same as front truck 120, except turned around 180 degrees (e.g., as used herein, to within 10 degrees, unless stated otherwise, and in some embodiments, to within 5, 4, 3, 2, or 1 degrees, as examples, or within an even smaller angle). In the embodiment depicted, rear truck 130 includes primary rear axle 131, and two primary rear wheels 133 and 134 rotatably mounted on primary rear axle 131. Various embodiments include at least one secondary rear axle (e.g., 132) that is parallel to the primary rear axle (e.g., 131). In this particular embodiment, for example, truck 130 includes one secondary rear axle 132 that is parallel to primary rear axle 131. Further, rear truck 130, in this particular embodiment, includes two secondary rear wheels 137 and 138 that are rotatably mounted on secondary rear axle 132.

Figure 5:
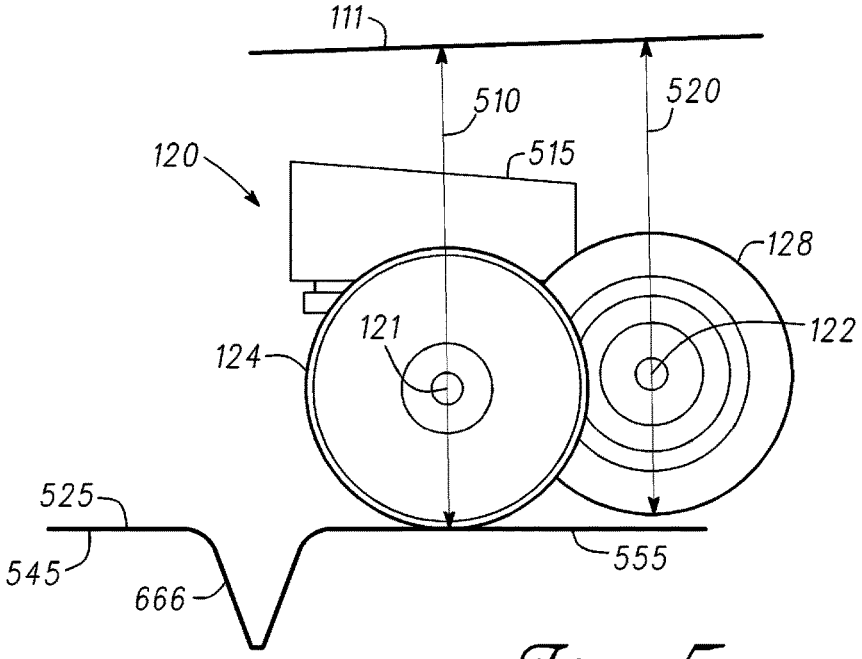
FIG. 5 is a left side detail view of a front truck of the skateboard of FIGS. 1 to 4 showing how the secondary wheels do not contact the riding surface, in this embodiment, if the riding surface is a flat plane.

As shown in FIG. 5, in the embodiment illustrated, primary front axle 121 is positioned (e.g., on skateboard 100, on truck 120, or both), so that the two primary front wheels 124 (shown) and 123 (behind and in line with 124 from the perspective of FIG. 5) extend further from top surface 111 (depicted by a line in FIG. 5, representing a side view of a plane) of body 110 (shown in FIGS. 1-4) of skateboard 100 than secondary front wheels 127 (shown in FIG. 5) and 128 (behind and in line with 127 from the perspective of FIG. 5). As used herein, in this context, top surface 111 is assumed to be a flat plane that is parallel to a plane running through primary axles 121 and 131 (e.g., shown in FIG. 2). In embodiments where top surface 111 is not actually a flat plane, as used herein, in this context, surface 111 should be assumed to be a flat plane that passes through the top of the skateboard and is parallel to a plane running through primary axles 121 and 131. Further, in the embodiment illustrated, truck 130 is the same as truck 120 shown in FIG. 5 except opposite hand. In this embodiment, primary rear axle 131 (corresponding to axle 121 shown in FIG. 5) is positioned so that the two primary rear wheels 133 and 134 (corresponding to wheel 124 shown in FIG. 5) extend further from top surface 111 of body 110 than the secondary rear wheels 137 and 138 (corresponding to wheel 127 shown in FIG. 5).

In various embodiments, when a skateboard (e.g., 100) is ridden on a flat plane, at least 75 percent of the weight of the rider is supported by the primary wheels (e.g., the two primary front wheels and the two primary rear wheels) rather than the secondary wheels. In the embodiment shown (e.g., in FIG. 5), primary front axle 121 is positioned so that the two primary front wheels 123 and 124 extend further from top surface 111 than secondary front wheels 127 and 128. Similarly, referring to FIG. 2, in a number of embodiments, primary rear axle 131 is positioned so that the two primary rear wheels 133 and 134 extend further from top surface 111 than secondary rear wheels 137 and 138 (e.g., similar to FIG. 5 except opposite hand). As a result, dimension 510 shown in FIG. 5 is greater than dimension 520, and the two primary front wheels 123 and 124 contact flat plane 555 (e.g., a flat section of sidewalk between cracks) while secondary front wheels 127 and 128 do not contact flat plane 555. Consequently, primary front wheels 123 and 124 support 100 percent of the weight of the rider that is supported by front portion 116 and truck 120 of skateboard 100, and secondary front wheels 127 and 128 support none of the weight of the rider that is supported by front portion 116 and truck 120 of skateboard 100. Similarly, in a number of embodiments, primary rear wheels 133 and 134 support 100 percent of the weight of the rider that is supported by rear portion 117 and truck 130 of skateboard 100, and secondary rear wheels 137 and 138 support none of the weight of the rider that is supported by rear portion 116 and truck 130 of skateboard 100.

Thus, in the embodiment illustrated, when skateboard 100 is ridden on a flat plane (e.g., 555), at least (e.g., more than) 75 percent of the weight of the rider is supported by the two primary front wheels 123 and 124 and the two primary rear wheels 133 and 134. In different embodiments, however, when the skateboard is ridden on a flat plane (e.g., 555), at least 50, 60, 70, 80, 90, or 95 percent of the weight of the rider is supported by the two primary front wheels and the two primary rear wheels, as examples, while the remainder is supported by the secondary wheels. In some embodiments, this percentage may vary, depending, for example, on the weight of the rider as the body of the skateboard may flex or bend as a result of the weight of the rider. As used herein this percentage should be determined using a rider that weighs 100 pounds under steady state conditions with no vertical acceleration.

Figure 6:
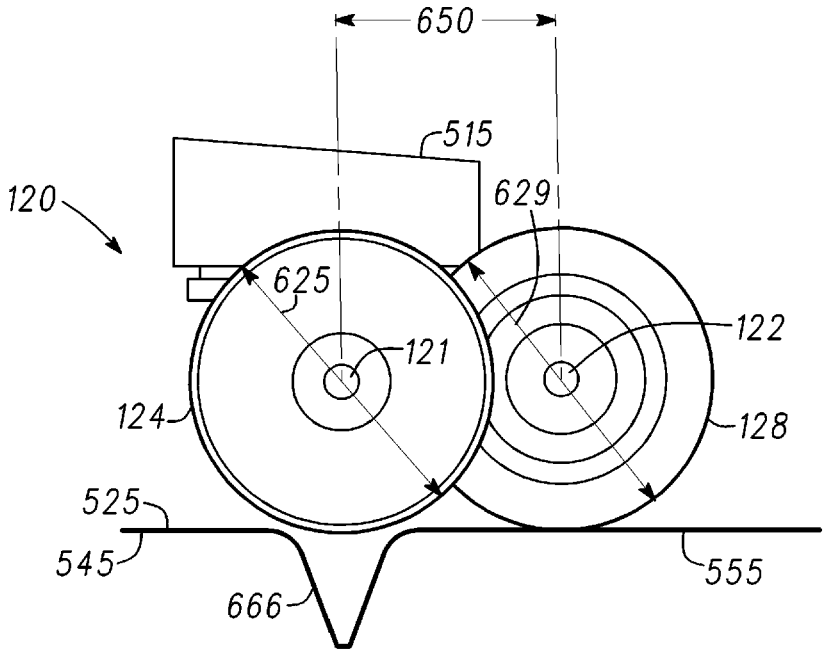
FIG. 6 is a left side detail view of the front truck of FIG. 5 of the skateboard of FIGS. 1 to 4 showing how the front secondary wheels support the front of the skateboard, in this embodiment, when the primary front wheels cross a crack in the riding surface, such as a sidewalk contraction joint.

FIG. 6 illustrates that when primary front wheels 124 (shown) and 123 (behind and in line with wheel 124) cross crack 666 (e.g., a contraction joint in sidewalk 525), primary front wheels 123 and 124 drop part way into crack 666 and truck 120 and front portion 116 of skateboard 100 are supported by secondary rear wheels 127 and 128 and secondary front axle 122. In the embodiment illustrated, the same is true for rear truck 130 and the primary and secondary rear wheels, except opposite hand. At the instant shown in FIG. 6, for the particular dimensions (e.g., width and depth) of crack 666, primary front wheels 123 and 124 are no longer in contact with sidewalk 525. This may depend on the dimensions of crack 666 and the angle at which skateboard 100 crosses crack 666, and other embodiments may differ. Secondary rear wheels 137 and 138 cross crack 666 before primary rear wheels 133 and 134, if skateboard 100 is moving forward, and secondary rear wheels 137 and 138 are supported by flat plane 545 of sidewalk 525 when primary rear wheels 133 and 134 cross crack 666 (e.g., the same as FIG. 6 but opposite hand).

In the embodiment illustrated, skateboard 100 is crossing crack 666 at a 90 degree angle. This can be a frequent occurrence for contraction joints and expansion joints in sidewalks that are perpendicular to the length of the sidewalk, and can also be encountered at isolation joints, for example, between a driveway and a sidewalk. In a number of embodiments, skateboard 100 may glide over cracks better or more easily if dimension 510, shown in FIG. 5, is close to dimension 520, but if dimension 510 is too close to dimension 520, the secondary wheels may touch the sidewalk continuously or more frequently and create undesirable drag or affect the handling characteristics of the skateboard. In some embodiments, however, the drag and handling characteristics are not an issue, or these issues are ameliorated or otherwise addressed, and dimension 510 is equal to or close to dimension 520. In various embodiments, the truck, skateboard, or both, are constructed so that the support of the primary and secondary axles are stiff so that the secondary wheels do not lift up very much when weight is transferred onto them, so the primary wheels do not spring downward when they cross a crack, or both. In various embodiments, the primary and secondary axles are suspended independently (e.g., rather than having a pivot between them that allows weight to be shared by the two axles).

In some embodiments, the skateboard, trucks, or both, are configured so the primary front axle is located in front of the at least one secondary front axle, the at least one secondary rear axle is located in front of the primary rear axle, or both. FIGS. 1-4 illustrate an example of such an embodiment. As used herein, in this context, "in front of" means farther in the direction that is towards front portion 116 and away from rear portion 117, for example. In the embodiment illustrated in FIGS. 1-4, primary front axle 121 is located in front of secondary front axle 122, and secondary rear axle 132 is located in front of primary rear axle 131.

Figure 8:
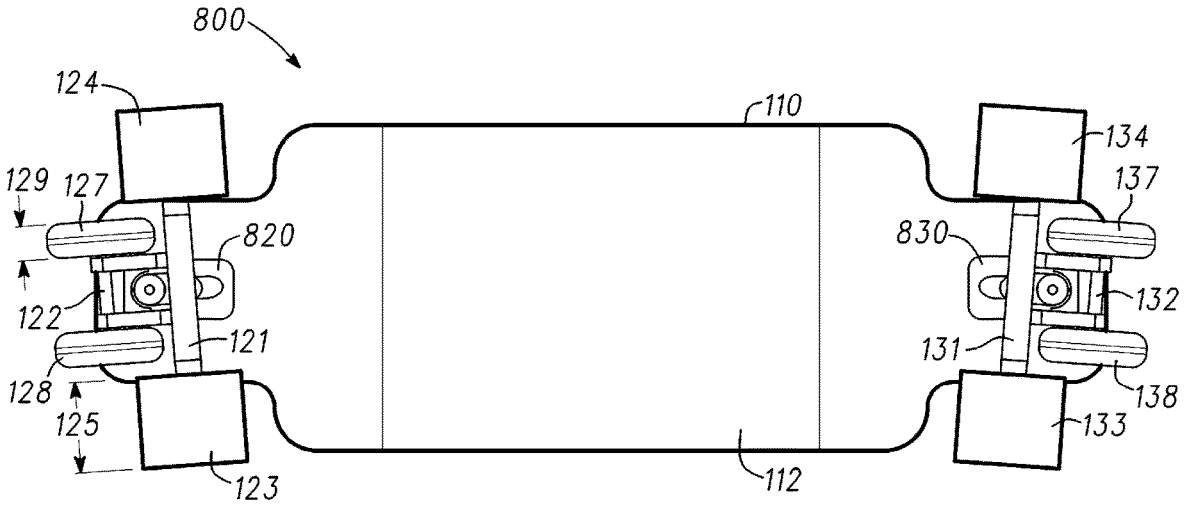
FIG. 8 is a bottom view of another embodiment of a skateboard having two dual-axle trucks, this embodiment of a skateboard also having four primary wheels and four secondary wheels, the skateboard shown with the trucks, axles, and wheels in the position when the skateboard turns to the right, and shown with the front of the skateboard on the left hand side of this view, this embodiment having the secondary wheels outboard of the primary wheels.
Figure 9:
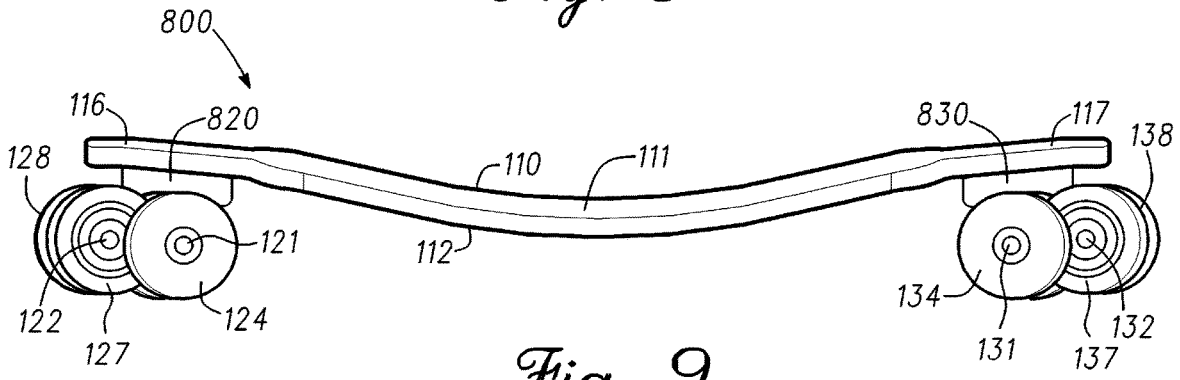
FIG. 9 is a left side view of the skateboard shown in FIG. 8, except shown with the wheels and body positioned so that the skateboard is turning to the left (e.g., toward the viewer)
Figure 10:
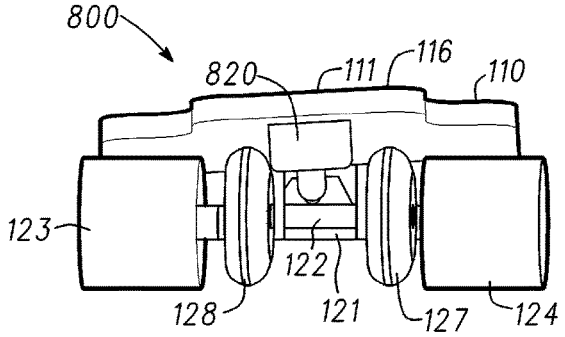
FIG. 10 is a front view of the skateboard of FIGS. 8 and 9 shown with the wheels and body positioned so that the skateboard is turning to the right.

In other embodiments, the skateboard, trucks, or both, are configured so the at least one secondary front axle is located in front of the primary front axle, the primary rear axle is located in front of the at least one secondary rear axle, or both. FIGS. 8-10 illustrate an example of such an embodiment.

FIGS. 8 to 10 illustrates an example of a skateboard, skateboard 800, which may be similar to skateboard 100 previously described except as described herein. In the example shown, skateboard 800 includes body 110 having top surface 111 (e.g., shown in FIGS. 9 and 10) for supporting the rider (i.e., of the skateboard), bottom surface 112 (e.g., shown in FIG. 8) opposite top surface 111, front portion 116, and rear portion 117 opposite front portion 116. In this embodiment, skateboard 800 also includes front truck 820 (e.g., shown in FIGS. 8-10) attached to bottom surface 112 of body 110 of skateboard 800 at front portion 116 of body 110. In this particular embodiment, front truck 820 includes primary front axle 121, and two primary front wheels 123 and 124 rotatably mounted (i.e., mounted so they can rotate) on primary front axle 121.

In the embodiment shown, skateboard 800 also includes rear truck 830 (e.g., shown in FIGS. 8 and 9) attached to bottom surface 112 of body 110 of skateboard 100 at rear portion 117 of body 110. In some embodiments, rear truck 830 is the same as front truck 820, except turned around 180 degrees (e.g., as used herein, to within 10 degrees, unless stated otherwise, and in some embodiments, to within 5, 4, 3, 2, or 1 degrees, as examples, or within an even smaller angle). In the embodiment depicted, rear truck 830 includes primary rear axle 131, and two primary rear wheels 133 and 134 rotatably mounted on primary rear axle 131. Further, rear truck 830, in this particular embodiment, includes two secondary rear wheels 137 and 138 that are rotatably mounted on secondary rear axle 132. In the embodiment illustrated in FIGS. 8-10, secondary front axle 122 is located in front of primary front axle 121, and primary rear axle 131 is located in front of secondary rear axle 132.

Further, in various embodiments, the two primary front wheels each have a primary front wheel width, the two secondary front wheels each have a secondary front wheel width, and the primary front wheel width is greater than the secondary front wheel width. In the embodiments depicted, the two primary front wheels 123 and 124 each have primary front wheel width 125 shown on FIGS. 1 and 8 for right primary front wheel 123, and the two secondary front wheels 127 and 128 each have secondary front wheel width 129 shown on FIGS. 1 and 8 for right secondary front wheel 127. In these examples, the two primary front wheels 123 and 124 each have the same primary front wheel width (i.e., 125), and the two secondary front wheels 127 and 128 each have the same secondary front wheel width (i.e., 129). Still further, in these embodiments, primary front wheel width 125 is greater than secondary front wheel width 129. In various embodiments, the primary wheels can be wider to make the skateboard more stable, to provide better adhesion in cornering, so that a softer compound can be used for the wheels, so the wheels will last longer, or a combination thereof, as examples. In different embodiments, for example, the primary wheels are 1.25, 1.5, 1.75, 2, 2.25, 2.5, 2.75, 2.9, 3, 3.1 3.25, 3.5, 3.75, 4, 4.25, 4.5, 4.75, 5, 5.5, 6, 7, or 8 times wider than the secondary wheels, as examples.

Moreover, in a number of embodiments, the two primary rear wheels each have a primary rear wheel width, the two secondary rear wheels each have a secondary rear wheel width, and the primary rear wheel width is greater than the secondary rear wheel width. In the embodiments illustrated, the front and rear wheels are the same. Thus, the two primary rear wheels 133 and 134 each have primary rear wheel width that is equal to primary front wheel width 125, the two secondary rear wheels 137 and 138 each have a secondary rear wheel width that is equal to secondary front wheel width 129, and the primary rear wheel width is greater than the secondary rear wheel width. Other embodiments may differ.

In a number of embodiments, the two primary front wheels each have a primary front wheel diameter, a secondary front wheel diameter, and a front axle spacing distance between primary front axle and the at least one secondary front axle is less than the primary front wheel diameter, the secondary front wheel diameter, or both. Moreover, in some embodiments, the front axle spacing distance between primary front axle and the at least one secondary front axle is less than the primary front wheel diameter plus the secondary front wheel diameter, that sum divided by two. In the embodiments illustrated, the two primary front wheels 123 and 124 each have a primary front wheel diameter 625 shown in FIG. 6 and a front axle spacing distance 650 between primary front axle 121 and secondary front axle 122. Further, in this embodiment, front axle spacing distance 650 is less than the primary front wheel diameter 625. Further still, in the embodiment shown in FIGS. 1-4, for example, as mentioned, truck 130 is the same as truck 120 except opposite hand, and the two primary rear wheels 133 and 134 each have a primary rear wheel diameter that is equal to primary front wheel diameter 625 shown in FIG. 6 and a rear axle spacing distance between primary rear axle 131 and secondary rear axle 132 that is equal to front axle spacing distance 650 between primary front axle 121 and secondary front axle 122, which is less than the primary rear wheel diameter.

In addition, in the embodiment shown in FIG. 6, the two secondary front wheels 127 and 128 each have a secondary front wheel diameter 629 and the front axle spacing distance 650 between primary front axle 121 and secondary front axle 122 is less than secondary front wheel diameter 629. Similarly, in this embodiment, the two secondary rear wheels 137 and 138 each have a secondary rear wheel diameter that is equal to secondary front wheel diameter 629 and a rear axle spacing distance between primary rear axle 131 and at least one secondary rear axle 132 that is equal to front axle spacing distance 650 and that is less than the secondary rear wheel diameter. Still further, in this embodiment, front axle spacing distance 650 is less than the primary front wheel diameter 625 plus the secondary front wheel diameter 629, all divided by two. Even further, in the embodiment shown, the same is true for rear truck 130. Namely, the rear axle spacing distance is less than the primary rear wheel diameter plus the secondary rear wheel diameter, all divided by two. Further, skateboard 800 and trucks 820 and 830 shown in FIGS. 8-10 may be similar.

Furthermore, in the embodiment illustrated, the two secondary front wheels 127 and 128 are located closer together (e.g., as shown in FIGS. 1, 3, 8, and 10), than the two primary front wheels 123 and 124. In other words, the distance between right secondary front wheel 127 and left secondary front wheel 128 is less, in a number of embodiments, than the distance between right primary front wheel 123 and left primary front wheel 124. In other words, the primary wheels have a wider track than the secondary wheels in a number of embodiments. This makes the skateboard (e.g., 100 or 800) more stable on the primary wheels, which are the wheels that support most of the weight under most circumstances, in many embodiments. Moreover, in various embodiments, the two secondary front wheels, for example, 127 and 128 extend between the two primary front wheels, for instance, 123 and 124. This can be seen, for example, in FIGS. 1, 2, 5, 6, 8, and 9, and is particularly clear in the side views of FIGS. 2, 5, 6, and 9 where part of secondary front wheel 128 is hidden behind primary wheel 124. Similarly, in the embodiments depicted, the two secondary rear wheels 137 and 138 are located closer together than the two primary rear wheels 133 and 134 and the two secondary rear wheels 137 and 138 extend between the two primary rear wheels 133 and 134. This allows the primary and secondary axles in each truck to be located more closely together. Other embodiments, however, may differ.

In some embodiments (e.g., as shown), the primary front wheels (e.g., 123 and 124) are the same as the primary rear wheels (e.g., 133 and 134), but in other embodiments, the primary front wheels are larger than the primary rear wheels. In some embodiments, this difference in wheel size (e.g., diameter) is selected because the front wheels are more likely to hang up on a small stone or other obstacle when the skateboard (e.g., 100 or 800) is going forward. Further, in some embodiments, the primary wheels (e.g., 123 and 124, 133 and 134, or both) are larger in diameter than the secondary wheels, while in other embodiments, the primary wheels are smaller in diameter than the secondary wheels. Further still, while the relative dimensions shown provide an example of relative sizes of components, in other embodiments, the primary wheels are larger (e.g., in diameter), for example, for riding on surfaces that are more uneven. Still further, in some embodiments, the size or diameter (e.g., 625 and 629) of the primary and secondary wheels can be selected or controlled to control the amount of weight supported by the secondary wheels when riding on a flat plane (e.g., 555), for instance, from zero (e.g., not contacting) to 50 percent. Even further, in some embodiments, the height of the primary and secondary axles can be selected or controlled to control the amount of weight supported by the secondary wheels when riding on a flat plane (e.g., 555), for instance, from zero to 50 percent.

Further, in some embodiments, some or all of the primary wheels are larger in diameter than some or all of the secondary wheels, while in other embodiments, some or all of the primary wheels are smaller in diameter than some or all of the secondary wheels. Thus, in some embodiments, primary front wheel diameter 625, shown in FIG. 6 is greater than secondary front wheel diameter 629, while in other embodiments, primary front wheel diameter 625, shown in FIG. 6 is less than secondary front wheel diameter 629. Still further, in certain embodiments, some or all of the primary wheels have the same diameter as some or all of the secondary wheels, and in particular embodiments, primary front wheel diameter 625, for example, is equal to secondary front wheel diameter 629. In particular embodiments, for example, primary front wheels 123 and 124 are larger in diameter than secondary front wheels 127 and 128, while in other embodiments, primary front wheels 123 and 124 are smaller in diameter than secondary front wheels 127 and 128, and in certain embodiments, primary front wheels 123 and 124 are the same size in diameter as secondary front wheels 127 and 128. Similarly, in certain embodiments, primary rear wheels 133 and 134 are larger in diameter than secondary rear wheels 137 and 138, while in other embodiments, primary rear wheels 133 and 134 are smaller in diameter than secondary rear wheels 137 and 138, and in certain embodiments, primary rear wheels 133 and 134 are the same size in diameter as secondary rear wheels 137 and 138.

In addition to complete skateboards, various embodiments include certain trucks for a skateboard, for example, to be ridden by a rider having a weight. Trucks 120 and 130 shown in FIGS. 1-3, 5, and 6, and trucks 820 and 830 shown in FIGS. 8-10 are examples. In a number of embodiments, such a truck can include a mounting surface for attaching the truck to a body of a skateboard, a primary axle, two primary wheels rotatably mounted on the primary axle, at least one secondary axle that is parallel to the primary axle, and two secondary wheels rotatably mounted on the at least one secondary axle, for example. Referring to FIGS. 5 and 6, truck 120, for example, includes mounting surface 515 for attaching truck 120 to a body of a skateboard (e.g., to body 110 of skateboard 100), primary (front) axle 121, and two primary (front) wheels 123 and 124 (the later shown, for example, in FIGS. 1-4), which are rotatably mounted on primary (front) axle 121. Further, in this embodiment, truck 120 also includes at least one (i.e., one) secondary (front) axle 122 that is parallel to primary (front) axle 121, and two secondary (front) wheels 127 and 128 that are rotatably mounted on secondary (front) axle 122. Truck 820 shown in FIGS. 8-10 may be similar except as described herein.

In various embodiments, the two primary wheels each have a primary wheel diameter, the two secondary wheels each have a secondary wheel diameter, an axle spacing distance between the primary axle and the at least one secondary axle is less than the primary wheel diameter, and the axle spacing distance between the primary axle and the at least one secondary axle is less than the secondary wheel diameter. For example, in the embodiment illustrated, the two primary wheels 123 and 124 each have primary wheel diameter 625 shown in FIG. 6, the two secondary wheels (e.g., 127 and 128) each have secondary wheel diameter 629, axle spacing distance 650 between primary axle 121 and secondary axle 122 is less than primary wheel diameter 625, and axle spacing distance 650 is less than secondary wheel diameter 629. Different embodiments include some or all of these relationships.

In the embodiment illustrated of truck 120, primary axle 121 is positioned so that the two primary wheels 123 and 124 extend further from mounting surface 515 of truck 120 than the two secondary wheels 127 and 128. Truck 820 may be similar except as described herein. In some embodiments, when two of the trucks (e.g., two trucks 120 or one each of trucks 120 and 130 where trucks 120 and 130 are the same, or two trucks 820 or one each of trucks 820 and 830 where trucks 820 and 830 are the same) are attached to the body (e.g., 110) of a skateboard (e.g., 100 or 800), at least 75 percent of the weight of the rider is supported by the primary wheels (e.g., 123 and 124, or 123, 124, 133, and 134) on the two trucks (e.g., 120, 120 and 130, 820, or 820 and 830) when the skateboard (e.g., 100 or 800) is ridden on a flat plane (e.g., 555). As mentioned, in other embodiments, this percentage may differ. Further, in some embodiments, the skateboard has a flat and horizontal bottom surface (e.g., analogous to 112) for attachment of the trucks, but in the embodiment illustrated, bottom surface 112 is not flat and mounting surface 515 is not horizontal. Other embodiments can differ.

In some embodiments, the two primary wheels each have a primary wheel width, the two secondary wheels each have a secondary wheel width, and the primary wheel width is greater than the secondary wheel width. In the embodiments shown, the two primary wheels 123 and 124 each have primary wheel width 125 (shown in FIGS. 1 and 8), the two secondary wheels (127 and 128 each have secondary wheel width 129 (shown in FIGS. 1 and 8), and primary wheel width 125 is greater than the secondary wheel width 129. Further, in various embodiments, the truck is configured so that the two secondary wheels are located closer together than the two primary wheels and the two secondary wheels extend between the two primary wheels. In the embodiments illustrated, for example, the two secondary wheels 127 and 128 are located closer together than the two primary wheels 123 and 124 and the two secondary wheels 127 and 128 extend between the two primary wheels 123 and 124. Various embodiments include different combinations of the features described herein. All conceivable combinations are contemplated.

Further embodiments include various methods, for instance, of obtaining or providing a skateboard, for example, that will glide over sidewalk cracks. As used herein, gliding over a crack means crossing the crack with less noise, with less shock (e.g., in a vertical direction), or with a smoother or more continuous motion, for instance, in comparison to a prior art skateboard, for example, a skateboard without secondary wheels, all other things being equal. Different methods include different combinations of certain acts, which may be performed in a workable order. The order described herein or shown on the drawings is an example of an order in which acts may be performed, but in other embodiments, the acts may be performed in a different order, at the same time, or during overlapping periods of time, as examples.

Figure 7:
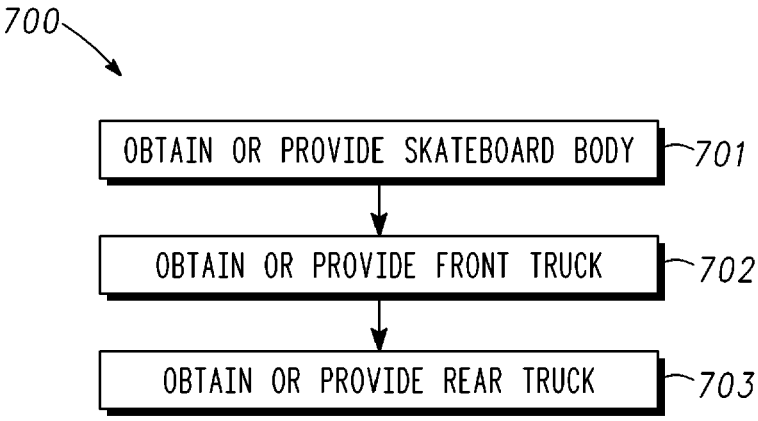
FIG. 7 is a flow chart illustrating an example of a method of obtaining or providing a skateboard (e.g., shown in FIG. 1-6 or 8-10) that will glide over sidewalk cracks.

An example of a method is method 700 shown in FIG. 7. Method 700 is an example of a method of obtaining or providing a skateboard (e.g., 100 or 800) that will glide over sidewalk cracks (e.g., 666 shown in FIG. 6). Method 700 includes, (e.g., in any order) at least the acts of obtaining or providing a skateboard body (act 701), obtaining or providing a front truck (act 702), and obtaining or providing rear truck (e.g., 703). In some embodiments, one or more of these acts, or another act, may include assembling the skateboard. In other embodiments, however the skateboard may be obtained or provided (e.g., in act 701, 702, 703, or a combination thereof) fully or partially assembled. In some embodiments, multiple or all of the acts of method 700 are performed at the same time. Although the phrase "a skateboard" is used in places herein, in some embodiments, acts are performed for multiple skateboards at one time or in succession, or both, as examples.

In some embodiments, act 701 of obtaining or providing a skateboard body includes obtaining or providing a skateboard body (e.g., 110) having a top surface (e.g., 111) for the rider of the skateboard (e.g., 100 or 800) to stand on, a bottom surface (e.g., 112), for instance, opposite the top surface, a front portion (e.g., 116), and a rear portion (e.g., 117), for example, opposite the front portion. Further, in some embodiments, act 702 of obtaining or providing a front truck includes obtaining or providing a front truck (e.g., 120 or 820), for instance, attached to the bottom surface (e.g., 112) of the body (e.g., 110) of the skateboard (e.g., 100), for example, at the front portion (e.g., 116) of the body. In a number of embodiments, the front truck (e.g., 120 or 820) includes two primary front wheels (e.g., 123 and 124) that rotate, for example, about a common primary front axis (e.g., of axle 121) and two secondary front wheels (e.g., 127 and 128) that rotate, for instance, about a common secondary front axis (e.g., of axle 122). An example of such an axis, is a centerline of an axle, for example, an axle that is in the shape of a right circular cylinder, for instance, which may include features such as threads, for instance, to secure a self locking nut at each end to secure the wheels, bearing races, threads that secure bearing races, or a combination thereof, as examples. In some embodiments, the secondary front axis is parallel to the primary front axis, for example.

Similarly, in various embodiments, act 703 of obtaining or providing a rear truck includes obtaining or providing a rear truck (e.g., 130 or 830), for instance, attached to the bottom surface (e.g., 112) of the body (e.g., 110) of the skateboard (e.g., 100 or 800), for example, at a rear portion (e.g., 117) of the body. In some embodiments, the rear truck (e.g., 130 or 830) includes two primary rear wheels (e.g., 133 and 134) that rotate, for instance, about a common primary rear axis (e.g., the centerline of primary rear axle 131) and two secondary rear wheels (e.g., 137 and 138) that rotate, for example, about a common secondary rear axis (e.g., the centerline of secondary rear axle 132). In certain embodiments, for instance, the secondary rear axis is parallel to the primary rear axis.

In a number of embodiments, the two primary front wheels (e.g., 123 and 124) and the two primary rear wheels (e.g., 133 and 134) are rigidly held extending lower than the two secondary front wheels (e.g., 127 and 128) and the two secondary rear wheels (e.g., 137 and 138), for example, so that at least a majority of the rider's weight is supported by the two primary front wheels (e.g., 123 and 124) and the two primary rear wheels (e.g., 133 and 134) when the rider rides the skateboard (e.g., 100 or 800) on a sidewalk (e.g., 525), for instance, where the sidewalk is flat (e.g., flat plane 555 shown in FIG. 5). In various embodiments, the two secondary front wheels (e.g., 127 and 128) and the two secondary rear wheels (e.g., 137 and 138) are rigidly held extending not as low as the two primary front wheels (e.g., 123 and 124) and the two primary rear wheels (e.g., 133 and 134), for example, so that, when the primary front wheels (e.g., 123 and 124) cross a crack (e.g., 666) in the sidewalk, the front portion (e.g., 116) of the skateboard (e.g., 100 or 800) is supported (e.g., as shown in FIG. 6) by the secondary front wheels (e.g., 127 and 128).

Similarly, in a number of embodiments, when the primary rear wheels (e.g., 133 and 134) cross the crack (e.g., 666) in the sidewalk (e.g., 525), the rear portion (e.g., 117) of the skateboard (e.g., 100 or 800) is supported by the secondary rear wheels (e.g., 137 and 138). In this context, the word "lower" refers to the downward direction when the skateboard is being ridden in its normal orientation on a flat horizontal surface or plane (e.g., 555 shown in FIG. 5). A wheel that extends lower, in a number of embodiments, contacts the riding surface (e.g., of the sidewalk) while, in some embodiments, wheels that do not extend as low do not necessarily contact the riding surface. Further, as used herein, "rigidly held" means that the skateboard body, trucks, wheels, axles, and other components, as applicable, are sufficiently stiff that the body of the skateboard dips when the primary wheels cross a crack less than half as far as the body would dip if the skateboard were ridden across the crack without the secondary wheels installed, for at least one dimension of a crack. In certain embodiments, however, the skateboard body, trucks, wheels, axles, and other components, as applicable, are sufficiently stiff that the body of the skateboard dips when the primary wheels cross a crack less than 10, 20, 30, 40, 50, 60, 70, 80, or 90 percent as far as the body would dip if the skateboard were ridden across the crack without the secondary wheels installed, for at least one dimension of a crack. Other embodiments may differ.

In some embodiments, act 702 (shown in FIG. 7) of obtaining or providing the front truck (e.g., 120 or 820) includes obtaining or providing the two primary front wheels (e.g., 123 and 124 shown in FIGS. 1-4 and 8-10), for instance, having a primary front wheel diameter (e.g., 625 shown in FIG. 6) and obtaining or providing the two secondary front wheels (e.g., 127 and 128), for example, having a secondary front wheel diameter (e.g., 629). Further, in a number of embodiments, act 703 of obtaining or providing the rear truck (e.g., 130 or 830) includes obtaining or providing the two primary rear wheels (e.g., 133 and 134 shown in FIGS. 1, 2, 4, 8, and 9) having a primary rear wheel diameter (e.g., equal to primary front wheel diameter 625 shown in FIG. 6) and obtaining or providing the two secondary rear wheels (e.g., 137 and 138) having a secondary rear wheel diameter (e.g., equal to secondary front wheel diameter 629, as examples.

In various embodiments, the primary axis is located in front of the secondary axis. Examples include the primary front axis of axle 121 of front truck 120 of skateboard 100 shown in FIGS. 1-3 which is located in front of the secondary front axis 122, and the primary rear axis of axle 131 of rear truck 820 of skateboard 800 shown in FIGS. 8 and 9 which is located in front of the secondary rear axis of secondary rear axle 132. In a number of embodiments, however, the secondary axis is located in front of the primary axis. Examples include the secondary rear axis 132 of rear truck 130 of skateboard 100 shown in FIGS. 1 and 2 which is located in front of the primary rear axis of axle 131, and the secondary front axis of secondary front axle 122 of front truck 820 of skateboard 800 shown in FIGS. 8 and 9 which is located in front of the primary front axis of front axle 121.

In particular embodiments, the primary front wheel diameter (e.g., 625 shown in FIG. 6 for left front wheel 124) is greater than the secondary front wheel diameter (e.g., 629 shown in FIG. 6 for left front wheel 124). Further, in some embodiments, the primary rear wheel diameter is greater than the secondary rear wheel diameter. In other embodiments, however, the primary front wheel diameter (e.g., 625) is less than the secondary front wheel diameter (e.g., 629, the primary rear wheel diameter is less than the secondary rear wheel diameter, or both. Further still, in some embodiments, the primary front wheel (e.g., 123 and 124) diameter (e.g., 625) is greater than the primary rear wheel (e.g., 133 and 134) diameter. In other embodiments, however, the primary front wheel (e.g., 123 and 124) diameter (e.g., 625) is equal to the primary rear wheel (e.g., 133 and 134) diameter.

Figure 2:
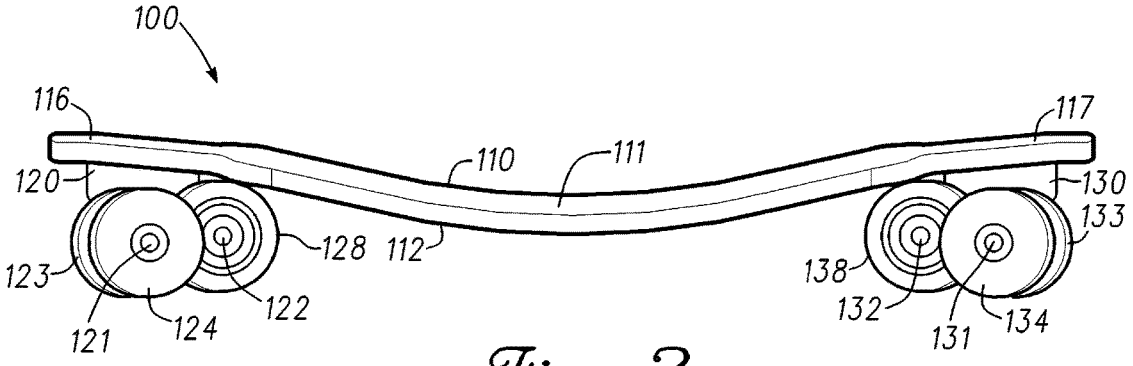
FIG. 2 is a left side view of the skateboard shown in FIG. 1, except shown with the wheels and body positioned so that the skateboard is turning to the left (e.g., toward the viewer)

Even further, in certain embodiments, act 702 of method 700 of obtaining or providing the front truck (e.g., 120 shown in FIGS. 1-3, 5, and 6 or 820 shown in FIGS. 8-10) includes obtaining or providing the two primary front wheels (e.g., 123 and 124 shown in FIGS. 1-6 and 8-10) having a primary front wheel width (e.g., 125 shown in FIGS. 1 and 8), and obtaining or providing the two secondary front wheels (e.g., 127 and 128 shown in FIGS. 1 and 8) having a secondary front wheel width (e.g., 129 shown in FIGS. 1 and 8). In a number of embodiments, the primary front wheel width (e.g., 125) is greater than the secondary front wheel width (e.g., 129), for instance, as shown, as described herein, or both. Similarly, in some embodiments, act 703 of obtaining or providing the rear truck (e.g., 130 shown in FIGS. 1 and 2 or 830 shown in FIGS. 8 and 9) includes obtaining or providing the two primary rear wheels (e.g., 133 and 134 shown in FIGS. 1, 4, and 8) having a primary rear wheel width (e.g., equal to the primary front wheel width 125 shown in FIGS. 1 and 8), and obtaining or providing the two secondary rear wheels (e.g., 137 and 138 shown in FIGS. 1 and 8) having a secondary rear wheel width (e.g., equal to the secondary front wheel width 129 shown in FIGS. 1 and 8). Furthermore, in a number of embodiments, the primary rear wheel width is greater than the secondary rear wheel width.

Further still, in some embodiments, act 702 of obtaining or providing the front truck (e.g., 120 shown in FIGS. 1-3, 5, and 6 or 820 shown in FIGS. 8-10) includes obtaining or providing a (front truck with a) front axis spacing distance (e.g., front axle spacing distance 650 shown in FIG. 6) between the primary front axis (e.g., of primary front axle 121) and the secondary front axis (e.g., of secondary front axle 122) that is less than the primary front wheel diameter (e.g., 625). Even further, in a number of embodiments, the front axis spacing distance (e.g., 650) between the primary front axis (e.g., 121) and the secondary front axis (e.g., 122) is less than the secondary front wheel diameter (e.g., 629). Still further, in some embodiments, act 703 of obtaining or providing the rear truck (e.g., 130 shown in FIGS. 1 and 2 or 830 shown in FIGS. 8 and 9) includes obtaining or providing a rear axis spacing distance (e.g., equal to front axis spacing distance 650 shown in FIG. 6) between the primary rear axis (e.g., of primary rear axle 131) and the secondary rear axis (e.g., of secondary rear axis 132) that is less than the primary rear wheel diameter (e.g., equal to primary front wheel diameter 625). Even further still, in a number of embodiments, the rear axis spacing distance between the primary rear axis and the secondary rear axis is less than the secondary rear wheel diameter (e.g., equal to secondary front wheel diameter 629).

Moreover, in a number of embodiments, act 702 of obtaining or providing the front truck (e.g., 120 or 820) includes obtaining or providing the two secondary front wheels (e.g., 127 and 128) located closer together than the two primary front wheels (e.g., 123 and 124). In particular embodiments, and the two secondary front wheels (e.g., 127 and 128) are located extending between the two primary front wheels (e.g., 123 and 124). See, for example, FIGS. 1-3 and 8-10. Similarly, in some embodiments, act 703 of obtaining or providing the rear truck (e.g., 130 or 830) includes obtaining or providing the two secondary rear wheels (e.g., 137 and 138) located closer together than the two primary rear wheels (e.g., 133 and 134) and the two secondary rear wheels (e.g., 137 and 138) extend between the two primary rear wheels (e.g., 133 and 134).

Figure 3:
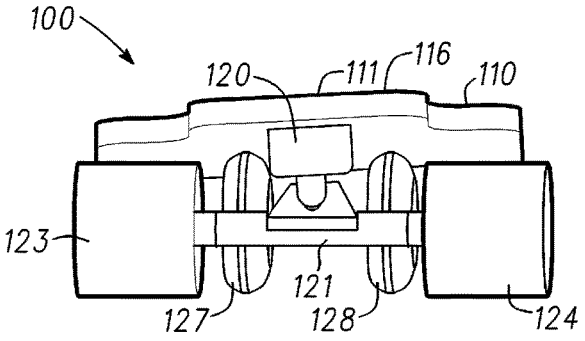
FIG. 3 is a front view of the skateboard of FIGS. 1 and 2 shown with the wheels and body positioned so that the skateboard is turning to the right.
Figure 4:
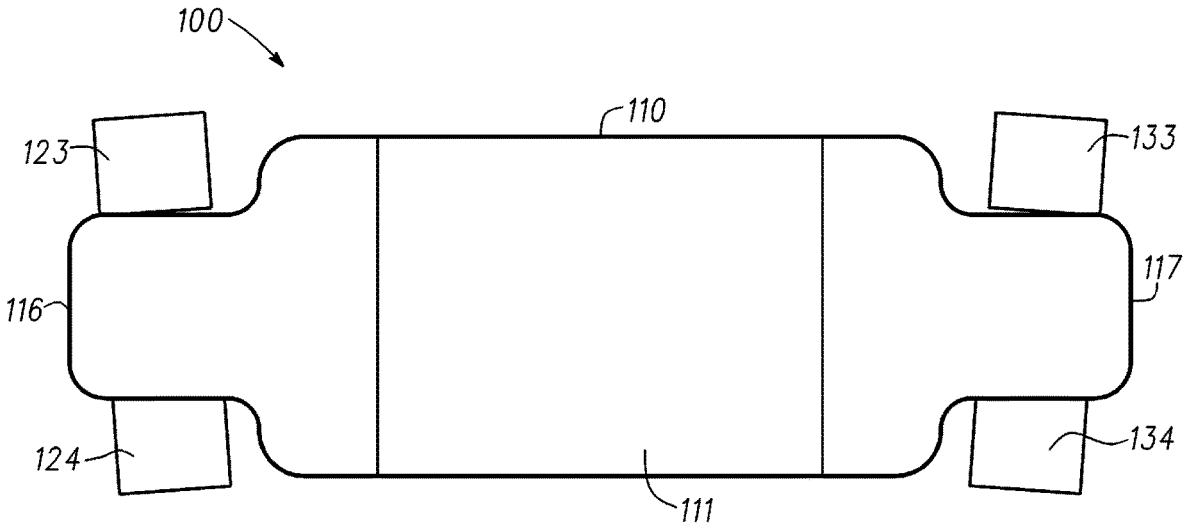
FIG. 4 is a top view of the skateboard shown in FIGS. 1 to 3, shown with the wheels positioned so that the skateboard is turning to the left.

Various embodiments include locating (e.g., in act 702 and 703, or in another act) the front truck (e.g., 120) and the rear truck (e.g., 130) on the skateboard body (e.g., 110) so that the primary wheels (e.g., 124, 125, 133, and 134) are outboard of the secondary wheels (e.g., 127, 128, 137, and 138), for instance, as shown in FIGS. 1-3. As used herein, "outboard" means farther from the center (e.g., of the skateboard). Further, as used herein, "locating" a truck on a skateboard body in a particular manner includes obtaining or providing the skateboard with the truck located on the skateboard body in that particular manner. Still further, other embodiments include locating the front truck (e.g., 820) and the rear truck (e.g., 830) on the skateboard body (e.g., 110) so that the secondary wheels (e.g., 127, 128, 137, and 138) are outboard of the primary wheels (e.g., 124, 125, 133, and 134), for instance, as shown in FIGS. 8-10. In a number of embodiments, the primary front axle (e.g., 121) is positioned so that the two primary front wheels (e.g., 124, and 125) extend further from the top surface (e.g., 112) of the body (e.g., 101) than the secondary front wheels (e.g., 127 and 128) and the primary rear axle (e.g., 131) is positioned so that the two primary rear wheels (e.g., 133 and 134) extend further from the top surface of the body than the secondary rear wheels (e.g., 137 and 138).

Various embodiments of the subject matter described herein include various combinations of the acts, structure, components, and features described herein, shown in the drawings, or known in the art. Moreover, certain procedures may include acts such as obtaining or providing various structural components described herein, obtaining or providing components that perform functions described herein. Furthermore, various embodiments include advertising and selling products that perform functions described herein, that contain structure described herein, or that include instructions to perform functions described herein, as examples. Such products may be obtained or provided through distributors, dealers, or over the Internet, for instance. The subject matter described herein also includes various means for accomplishing the various functions or acts described herein or apparent from the structure and acts described.

The invention claimed is:

1. A truck for a skateboard, the truck comprising:
- a mounting surface for attaching the truck to a body of the skateboard;
- a primary axle;
- two primary wheels rotatably mounted on the primary axle;
- at least one secondary axle that is parallel to the primary axle; and
- two secondary wheels rotatably mounted on the at least one secondary axle;
- wherein:
  - the two primary wheels each have a primary wheel diameter;
  - the two secondary wheels each have a secondary wheel diameter; and
  - an axle spacing distance between the primary axle and the at least one secondary axle is less than a sum of the primary wheel diameter and the secondary wheel diameter divided by two.

2. The truck of claim 1, wherein the secondary wheel diameter is less than the primary wheel diameter.

3. The truck of claim 1, wherein the secondary wheel diameter is greater than the primary wheel diameter.

4. The truck of claim 1, wherein the primary axle is positioned so that the two primary wheels extend further from the mounting surface of the truck than the two secondary wheels.

5. The truck of claim 1, wherein the primary axle is positioned so that the two secondary wheels extend further from the mounting surface of the truck than the two primary wheels.

6. The truck of claim 1, wherein:
the two primary wheels each have a primary wheel width;
the two secondary wheels each have a secondary wheel width; and
the primary wheel width is greater than the secondary wheel width.

7. The truck of claim 1, wherein the mounting surface is attached to a rear portion of the body of the skateboard.

8. The truck of claim 1, wherein the mounting surface is attached to a front portion of the body of the skateboard.

9. The truck of claim 8, wherein:
the primary axle is located in front the at least one secondary axle.

10. The truck of claim 8, wherein:
the at least one secondary axle is located in front of the primary axle.

11. A skateboard comprising:
a front truck attached to a front portion of a body of the skateboard, comprising:
a primary front axle with two primary front wheels rotatably mounted on the primary front axle;
at least one secondary front axle parallel to the primary front axle, with two secondary front wheels rotatably mounted on the at least one secondary front axle;
wherein
the two primary front wheels each have a primary front wheel diameter;
the two secondary front wheels each have a secondary front wheel diameter; and
an axle spacing distance between the primary front axle and the at least one secondary front axle is less than a sum of the primary front wheel diameter and the secondary front wheel diameter divided by two; and
a rear truck attached to a rear portion of the body of the skateboard, comprising:
a primary rear axle with two primary rear wheels rotatably mounted on the primary rear axle;
at least one secondary rear axle parallel to the primary rear axle, with two secondary rear wheels rotatably mounted on the at least one secondary rear axle; wherein
the two primary rear wheels each have a primary rear wheel diameter;
the two secondary rear wheels each have a secondary rear wheel diameter; and
an axle spacing distance between the primary rear axle and the at least one secondary rear axle is less than a sum of the primary rear wheel diameter and the secondary rear wheel diameter divided by two.

12. The skateboard of claim 11, wherein the secondary rear wheel diameter is less than the primary front wheel diameter.

13. The skateboard of claim 11, wherein the secondary rear wheel diameter is greater than the primary front wheel diameter.

14. The skateboard of claim 11, wherein:
the primary front axle is positioned in front of the at least one secondary front axle; and
the at least one secondary rear axle is positioned in front of the primary rear axle.

15. The skateboard of claim 11, wherein:
the at least one secondary front axle is positioned in front of the primary front axle; and
the primary rear axle is positioned in front of the at least one secondary rear axle.

16. The skateboard of claim 11, wherein:
the two primary front wheels each have a primary front wheel width;
the two secondary front wheels each have a secondary front wheel width;
the two primary rear wheels each have a primary rear wheel width; and
the two secondary rear wheels each have a secondary rear wheel width; wherein
the primary front wheel width is greater than the secondary front wheel width; and
the primary rear wheel width is greater than the secondary rear wheel width.

17. The skateboard of claim 16, wherein:
the primary front wheels are 1.25 times wider than the secondary front wheels and the primary rear wheels are 1.25 times wider than the secondary rear wheels.

18. The skateboard of claim 16, wherein:
the primary front wheel width is equal to the primary rear wheel width, and the secondary front wheel width is equal to the secondary rear wheel width.

19. The skateboard of claim 11, wherein:
the two secondary front wheels are located closer together than the two primary front wheels;
the two secondary rear wheels are located closer together than the two primary rear wheels;
the two secondary rear wheels extend between the two primary front wheels; and
the two secondary rear wheels extend between the two primary rear wheels.

20. A truck for a skateboard, the truck comprising:
a mounting surface for attaching the truck to a body of the skateboard;
a primary axle;
two primary wheels rotatably mounted on the primary axle;
at least one secondary axle that is parallel and rearward to the primary axle; and
two secondary wheels rotatably mounted on the at least one secondary axle;
wherein:
a distance measured between the two secondary wheels is less than a distance between the two primary wheels;
the two primary wheels each have a primary wheel diameter;
the two secondary wheels each have a secondary wheel diameter;
the secondary wheel diameter is equal to the primary wheel diameter; and
an axle spacing distance between the primary axle and the at least one secondary axle is less than a sum of the primary wheel diameter and the secondary wheel diameter divided by two.

* * * * *